US011500310B2

(12) United States Patent
Fujii et al.

(10) Patent No.: US 11,500,310 B2
(45) Date of Patent: Nov. 15, 2022

(54) IMAGE FORMING APPARATUS CAPABLE OF SUPRESSING DEGRADATION IN WORKABILITY AT THE TIME OF TRANSFER BELT REPLACEMENT

(71) Applicant: CANON KABUSHIKI KAISHA, Tokyo (JP)

(72) Inventors: Daisuke Fujii, Chiba (JP); Kentaro Yamana, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/518,439

(22) Filed: Nov. 3, 2021

(65) Prior Publication Data

US 2022/0146969 A1 May 12, 2022

(30) Foreign Application Priority Data

Nov. 12, 2020 (JP) ..... JP2020-188976

(51) Int. Cl.
*G03G 15/16* (2006.01)

(52) U.S. Cl.
CPC ..... *G03G 15/1615* (2013.01); *G03G 15/161* (2013.01)

(58) Field of Classification Search
CPC . G03G 15/1615; G03G 15/161; G03G 21/168
USPC ..... 399/121, 302
See application file for complete search history.

(56) References Cited

U.S. PATENT DOCUMENTS 9,409,429 B2 * 8/2016 Koshida ..... G03G 15/161
9,778,600 B2 * 10/2017 Makinodan ..... G03G 15/1615
10,691,044 B2 * 6/2020 Fujii et al. ..... G03G 15/161

FOREIGN PATENT DOCUMENTS

JP 2014178510 A 9/2014

* cited by examiner

*Primary Examiner* — William J Royer
(74) *Attorney, Agent, or Firm* — Canon U.S.A., Inc. I.P. Division

(57) ABSTRACT

An image forming apparatus includes an image forming unit and a belt conveyance apparatus. The belt conveyance apparatus includes a transfer belt, a tension roller, a movement mechanism, and a drive unit. A toner image on an image bearing member is transferred to the transfer belt in tension from the tension roller. The movement mechanism moves the tension roller to apply tension to, and release tension from, the transfer belt. The drive unit is disposed in a width direction and drives the transfer belt. The movement mechanism includes an attachment portion disposed on a side opposite the drive unit in the width direction and to which a handle member that operates the movement mechanism is detachably attached. The movement mechanism is configured such that the belt conveyance apparatus is attached to an image forming apparatus body in a state in which the handle member is detached from the attachment portion.

5 Claims, 8 Drawing Sheets

IMAGE FORMING APPARATUS CAPABLE OF SUPRESSING DEGRADATION IN WORKABILITY AT THE TIME OF TRANSFER BELT REPLACEMENT

BACKGROUND

Field

The present disclosure relates to an image forming apparatus that includes a detachable belt conveyance apparatus including a transfer belt to which a toner image is to be transferred.

Description of the Related Art

In recent years, a full-color tandem machine has been proposed with respect to an image forming apparatus such as a printer, a copying machine, and a facsimile machine to form a color image at high speed and with high image quality. A representative configuration of the tandem machine includes four image forming stations for yellow (Y), magenta (M), cyan (C), and black (K) that are aligned in a movement direction of a transfer belt. In such a configuration, toner images of respective colors of yellow, magenta, cyan, and black, which are sequentially formed in the respective image forming stations, are transferred to the transfer belt (primary transfer) in an overlapping manner. Subsequently, the toner images are collectively transferred from the transfer belt to a recording medium (secondary transfer). The toner image formed on the recording medium is fixed, so that a full-color image or a monochrome image is formed.

In such an image forming apparatus, components and units such as an image forming unit, a transfer belt, and various rollers are regularly replaced to continue to provide stable images to consumers. Out of the components and units to be regularly replaced, a belt conveyance apparatus that conveys the transfer belt has the transfer belt the endurance life of which is relatively shorter than that of an apparatus body of the belt conveyance apparatus. Thus, the transfer belt is regularly replaced from a running cost standpoint. When the transfer belt is replaced, the belt conveyance apparatus is removed from an image forming apparatus body. Then, a tension roller is separated from a projection line that is provided when the transfer belt is stretched. The tension roller is separated so that the transfer belt is inserted into and/or removed from the belt conveyance apparatus. That is, a tension roller separation configuration for releasing a pressure applied to the transfer belt by the tension roller has been proposed. In the tension roller separation configuration, a separation operation may be manually performed. In such a case, an operation lever is attached to the apparatus body of the belt conveyance apparatus (Japanese Patent Application Laid-Open No. 2014-178510).

The operation lever (hereinafter, also referred to as a handle member) of the tension roller separation configuration can be integrated on a drive unit side of the belt conveyance apparatus to reduce a size of the belt conveyance apparatus body. In such a case, the drive unit of the belt conveyance apparatus interferes with an insertion-removal trajectory of the transfer belt at the time of belt replacement. Thus, in a belt width direction, the transfer belt is generally inserted and/or removed from a side opposite the side on which the drive unit is disposed. Accordingly, in the belt width direction, the side from which the transfer belt is to be inserted and/or removed (the side opposite the belt drive unit) is positioned opposite an installation position of the operation lever (on the drive unit side). Consequently, when a pressure on the tension roller is released at the time of belt replacement, an orientation of the belt conveyance apparatus needs to be changed so that the handle member is accessed. Such a change degrades workability of the belt replacement.

SUMMARY

The present disclosure is directed to an image forming apparatus capable of suppressing degradation in workability at the time of belt replacement while suppressing an increase in size of a belt conveyance apparatus.

According to an aspect of the present disclosure, an image forming apparatus includes an image forming unit configured to form a toner image on an image bearing member, and a belt conveyance apparatus detachably disposed, wherein the belt conveyance apparatus includes a transfer belt, a tension roller, a movement mechanism, and a drive unit, wherein the toner image formed on the image bearing member is to be transferred to the transfer belt, and the tension roller is configured to apply tension to the transfer belt, wherein the movement mechanism is configured to move the tension roller to a position in which the tension is applied to the transfer belt and a position in which the tension to the transfer belt is released, and the drive unit is disposed on one end side of the transfer belt in a width direction and configured to drive the transfer belt, and wherein the movement mechanism includes an attachment portion that is disposed on a side opposite the drive unit in the width direction and to which a handle member configured to operate the movement mechanism is detachably attached, and the movement mechanism is configured such that the belt conveyance apparatus is attached to a body of the image forming apparatus in a state in which the handle member is detached from the attachment portion.

Further features of the present disclosure will become apparent from the following description of exemplary embodiments with reference to the attached drawings.

DESCRIPTION OF THE EMBODIMENTS

<Image Forming Apparatus>

Figure 1:
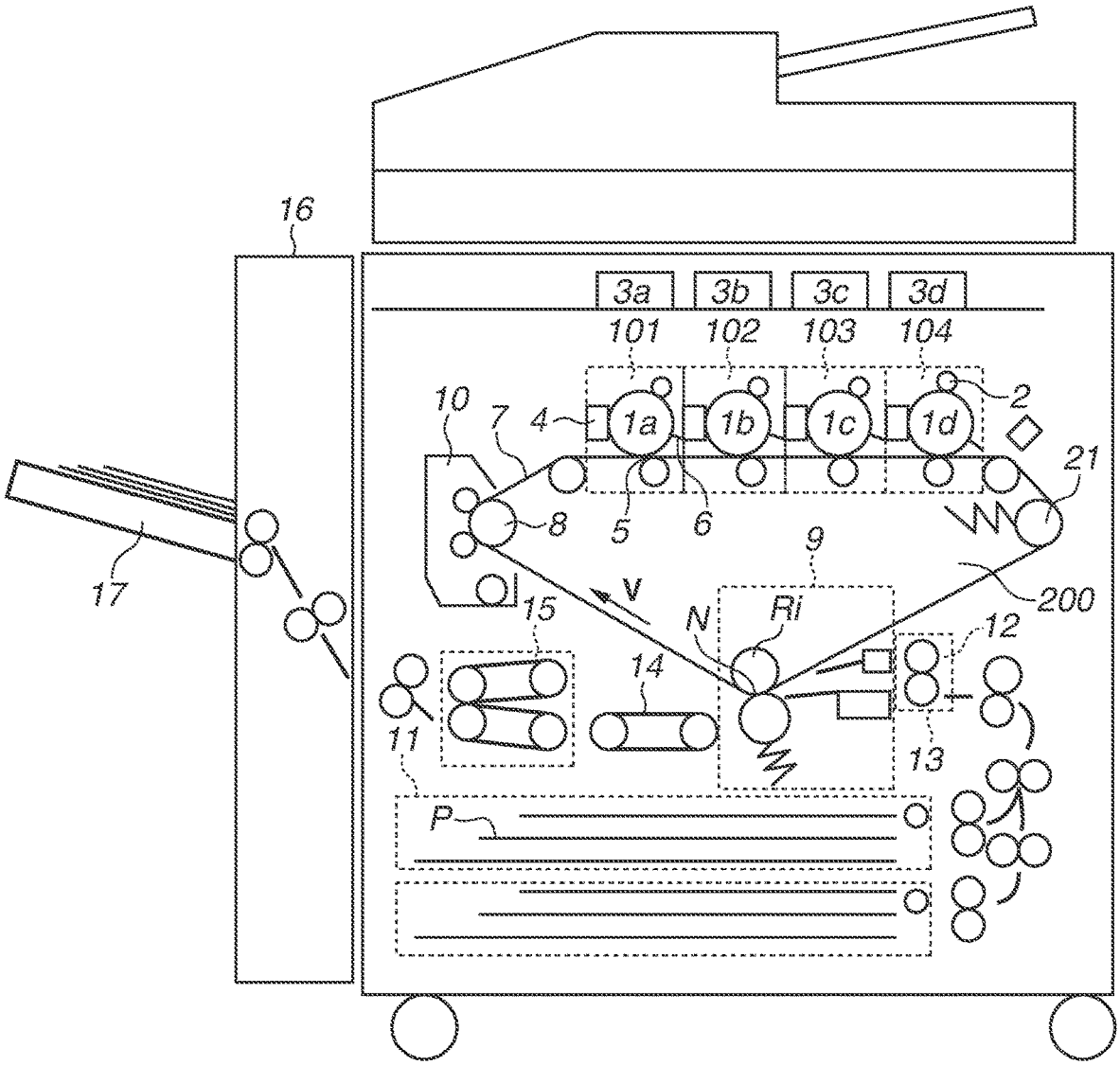
FIG. 1 is a schematic sectional view illustrating an image forming apparatus.

FIG. 1 illustrates an image forming apparatus according to the present exemplary embodiment. The image forming apparatus of the present exemplary embodiment includes image forming stations (101, 102, 103, and 104) as image forming units for four colors (yellow, magenta, cyan, and black). The image forming stations 101, 102, 103, and 104 respectively include rotatable photosensitive drums 1*a*, 1*b*, 1*c*, and 1*d* as image bearing members. On the peripheries of the photosensitive drums 1*a*, 1*b*, 1*c*, and 1*d*, charging devices 2, exposure devices 3*a*, 3*b*, 3*c*, and 3*d*, and developing devices 4 are respectively disposed along rotation directions of the photosensitive drums 1*a*, 1*b*, 1*c*, and 1*d*. Moreover, primary transfer units 5, and cleaning units 6 are respectively disposed along the rotation directions of the photosensitive drums 1*a*, 1*b*, 1*c*, and 1*d*.

A transfer belt 7 having an endless belt shape is disposed below the photosensitive drums 1*a*, 1*b*, 1*c*, and 1*d* in the respective image forming stations 101, 102, 103, and 104. The transfer belt 7 is looped around a plurality of rollers. A driving force is input to a drive roller 8, which is one of the plurality of rollers, so that the transfer belt 7 is rotated. Toner images formed by the respective image forming stations (101, 102, 103, and 104) are transferred to the transfer belt 7 in positions of the respective primary transfer units 5.

On the periphery of the transfer belt 7, a secondary transfer unit 9 and a transfer clearing device 10 are disposed. The secondary transfer unit 9 includes a secondary transfer nip N that is as an area where the toner image is transferred from a surface of the transfer belt 7 to recording paper P. The transfer clearing device 10 collects residual toner that has remained on the surface of the transfer belt 7 without being transferred by the secondary transfer unit 9.

The recording paper P is fed from a sheet feeding unit disposed in a paper storage 11. After an orientation of the recording paper P is adjusted by a registration adjustment unit 12, the recording paper P is conveyed to the secondary transfer unit 9.

The registration adjustment unit 12 includes a pair of registration rollers 13 and a registration drive unit (not illustrated) for driving the registration rollers 13, and rotation of the registration rollers 13 conveys the recording paper P.

The recording paper P on which the toner image has been transferred is conveyed to a conveyance belt 14. The conveyance belt 14 is driven by a conveyance drive motor (not illustrated). A suction fan is disposed inside the conveyance belt 14 to suction the recording paper P, so that the recording paper P is suctioned toward the conveyance belt 14. Then, the recording paper P is conveyed to a fixing unit 15 disposed downstream of the conveyance belt 14. The fixing unit 15 fixes the toner image with heat and pressure, so that the recording paper P on which the toner image has been fixed is obtained. Subsequently, the recording paper P is conveyed to a discharge device 16, and is then discharged on a discharge tray 17 disposed outside the image forming apparatus.

<Belt Conveyance Apparatus>

Figure 2A:
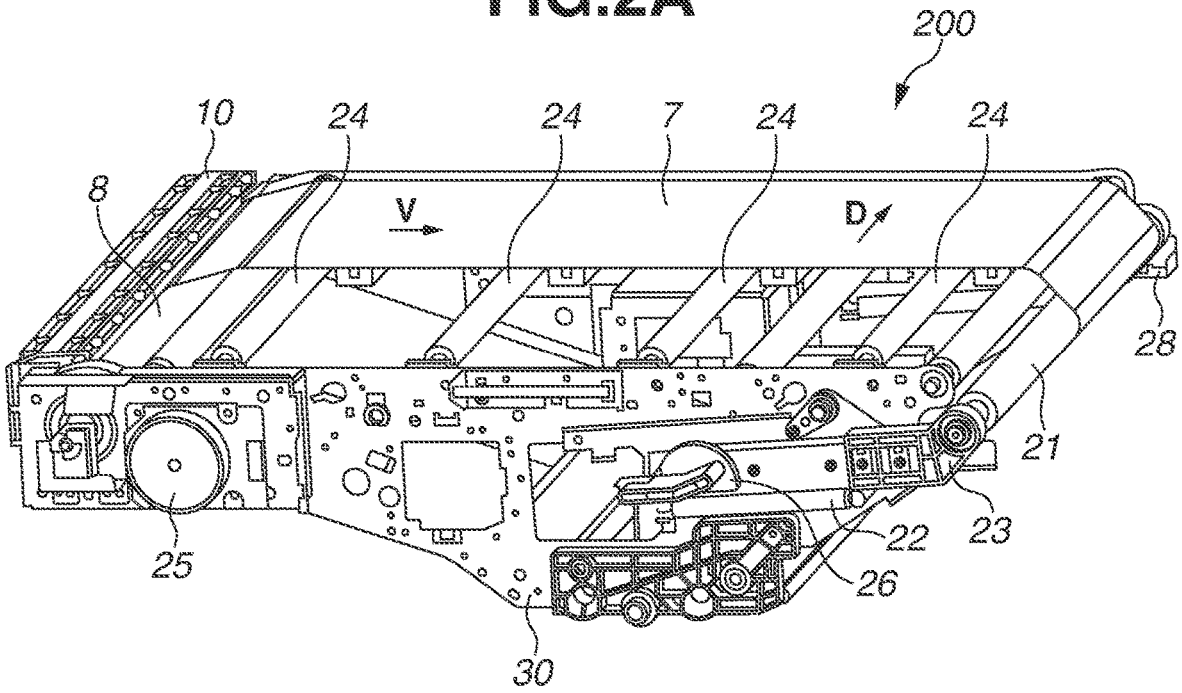
FIGS. 2A and 2B are perspective views each illustrating a belt conveyance apparatus according to the present exemplary embodiment.
Figure 2B:
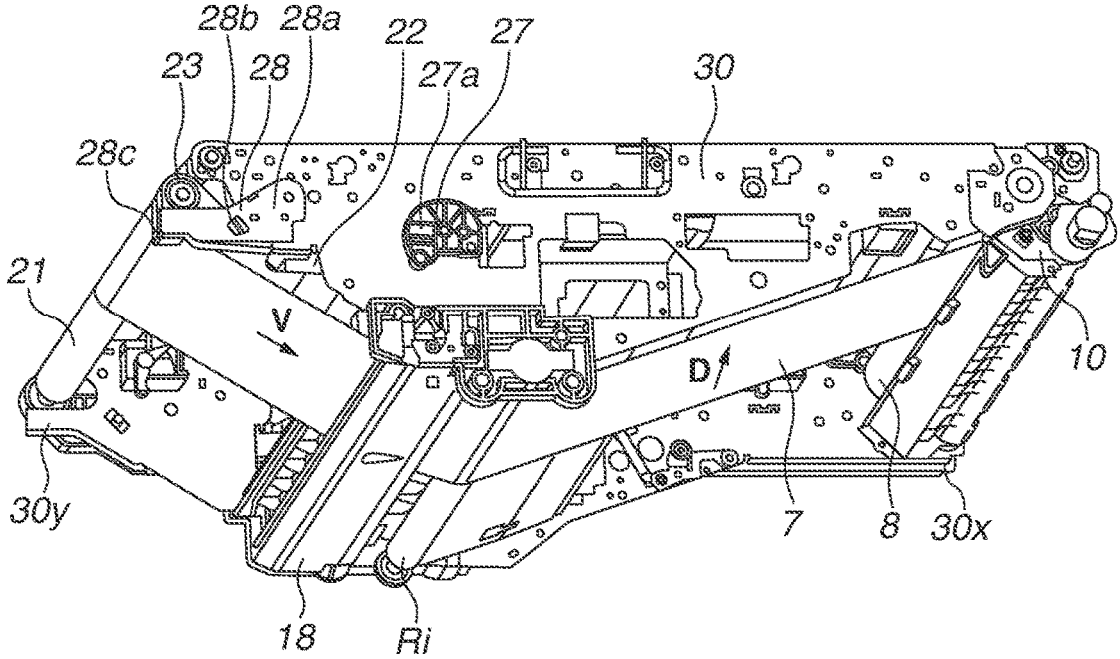

A belt conveyance apparatus 200 is described. FIGS. 2A and 2B are perspective views each illustrating the belt conveyance apparatus 200 in which the transfer belt 7 is disposed. In each of FIGS. 2A and 2B, only a half of the transfer belt 7 in a width direction is illustrated for the sake of description. FIG. 2A illustrates a drive unit side (an apparatus body front side), whereas FIG. 2B illustrates a belt insertion-removal side to be used at the time of belt replacement. As illustrated in each of FIGS. 2A and 2B, a secondary transfer inner roller Ri, a drive roller 8, and a primary transfer roller 24 are rotatably supported with respect to a frame 30. A tension roller 21 is rotatably supported via a tension roller bearing 23, which is pressed by a tension roller spring 22 such that a tensile force is applied to the transfer belt 7 toward the outside.

As illustrated in FIG. 2A, a drive unit 25 is attached to one end side of the drive roller 8 in an axial direction. The drive unit 25 is connected to an output shaft using a gear to transmit a driving force. The drive roller 8 has a surface that is made of a material, such as rubber, having a relatively high friction coefficient. The drive force is transmitted to the drive roller 8, so that the surface of the drive roller 8 conveys and drives the transfer belt 7 in a direction indicated by an arrow V illustrated in FIG. 2A.

For replacement of a consumable item such as the transfer clearing device 10 and the transfer belt 7, the belt conveyance apparatus 200 needs to be removed from an image forming apparatus body. Thus, the belt conveyance apparatus 200 is insertable and removable by a rail (not illustrated) as a guide rail disposed in the image forming apparatus body.

As illustrated in FIG. 2B, the belt conveyance apparatus 200 includes leg portions 30*x* and 30*y* of the frame 30 of the belt conveyance apparatus 200, and an insertion-removal guide member 28 disposed on a belt insertion-removal side D. The leg portions 30*x* and 30*y* and the insertion-removal guide member 28 are guided by contacting the rail, so that the belt conveyance apparatus 200 can be inserted and/or removed. Moreover, the insertion-removal guide member 28 can be used as a handle in a case where the belt conveyance apparatus 200 is removed from the image forming apparatus body. In such a case, the insertion-removal guide member 28 as a handle is held and pulled out.

Figure 8:
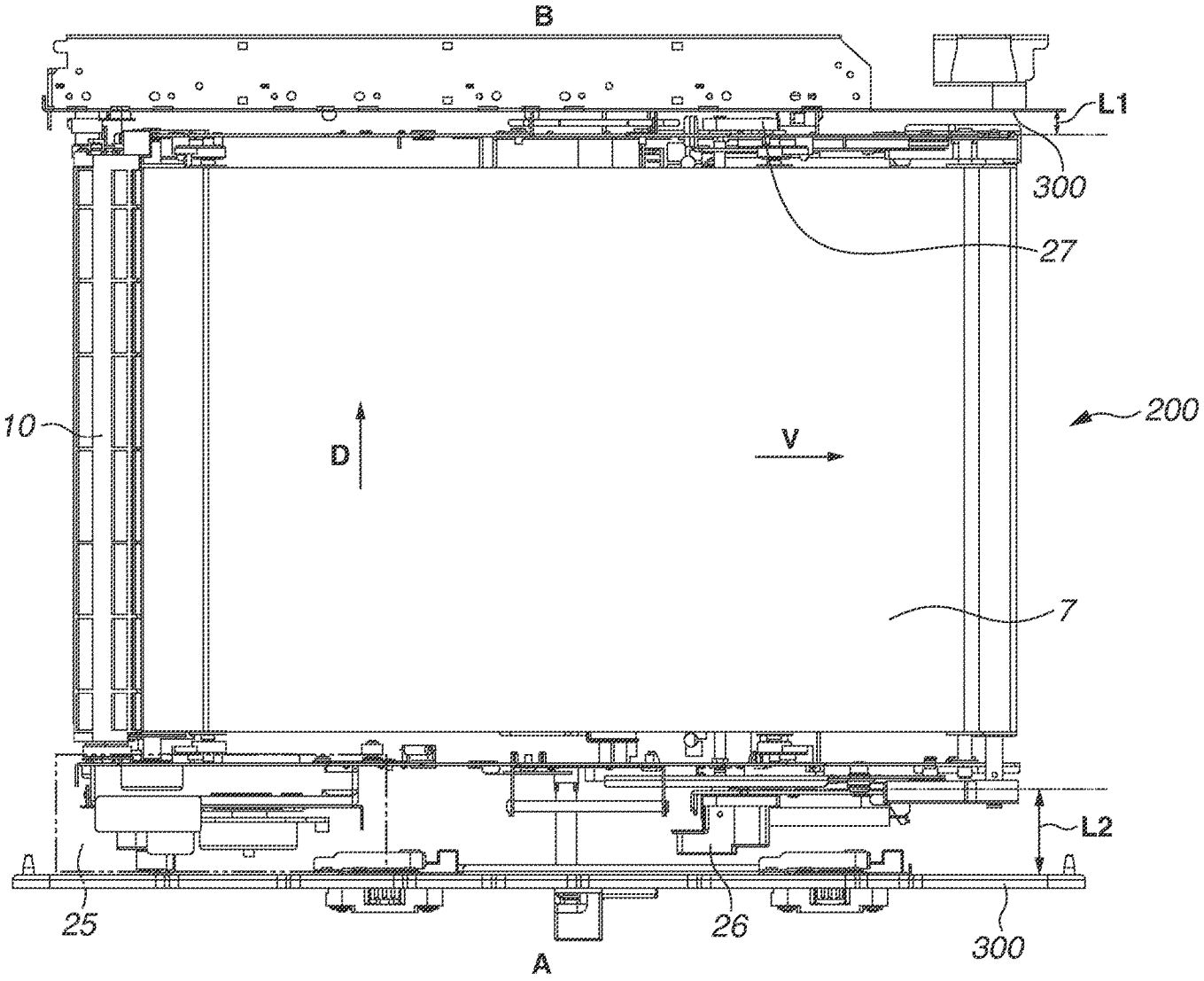
FIG. 8 is a top view illustrating the belt conveyance apparatus according to the present exemplary embodiment.

FIG. 8 is a top view illustrating the belt conveyance apparatus 200 inside the image forming apparatus body according to the present exemplary embodiment. As illustrated in FIG. 8, in a case where the transfer belt 7 is inserted into and/or removed from the belt conveyance apparatus 200, insertion and/or removal of the transfer belt 7 from a side A (the drive unit side) causes the transfer belt 7 and the drive unit 25 to interfere with each other. Consequently, the transfer belt 7 cannot be inserted and/or removed. That is, one portion of the drive unit 25 is disposed outside relative to a stretch cross section (an outer circumferential surface) of the transfer belt 7 as viewed from a width direction of the transfer belt 7. Accordingly, when the transfer belt 7 is replaced, the transfer belt 7 is inserted and/or removed from a side B (a side opposite the drive unit 25).

On the side B of the belt conveyance apparatus 200, a distance L1 between the belt conveyance apparatus 200 and an apparatus body side plate 300 is configured to be short to save space. On the other hand, on the side A where the drive unit 25 is disposed, a distance L2 between the belt conveyance apparatus 200 and the apparatus body side plate 300 is configured to be longer than the distance L1 to dispose the drive unit 25.

<Tension Roller Mechanism>

Figure 3A:
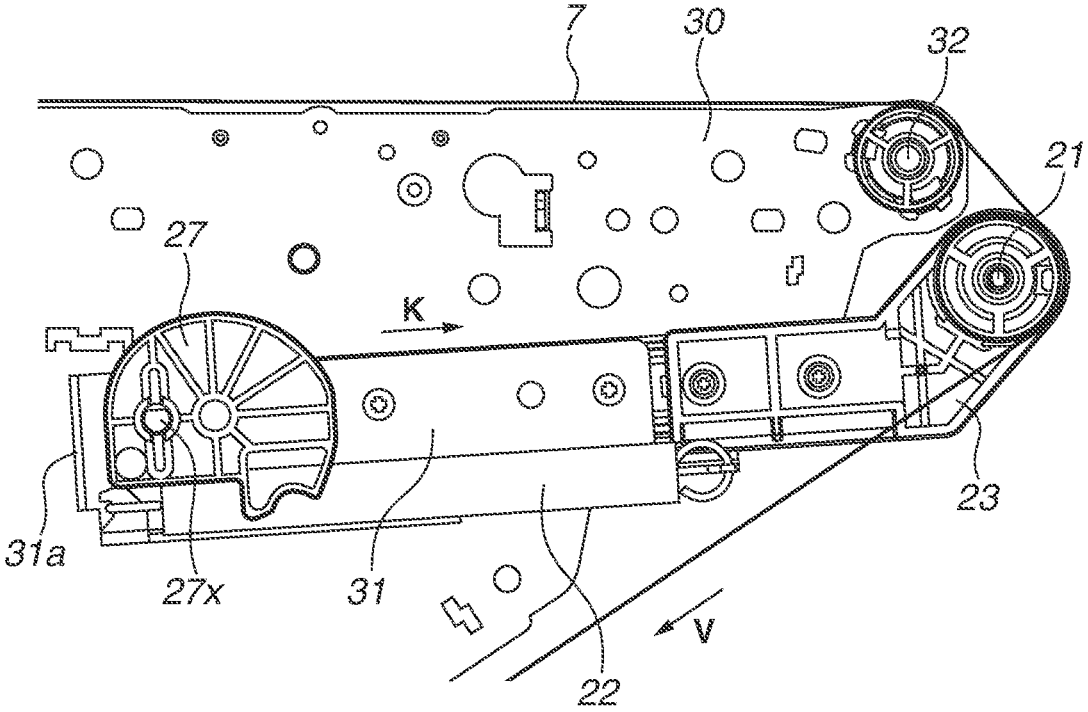
FIGS. 3A and 3B are schematic sectional views each illustrating a tension roller mechanism according to the present exemplary embodiment.
Figure 3B:
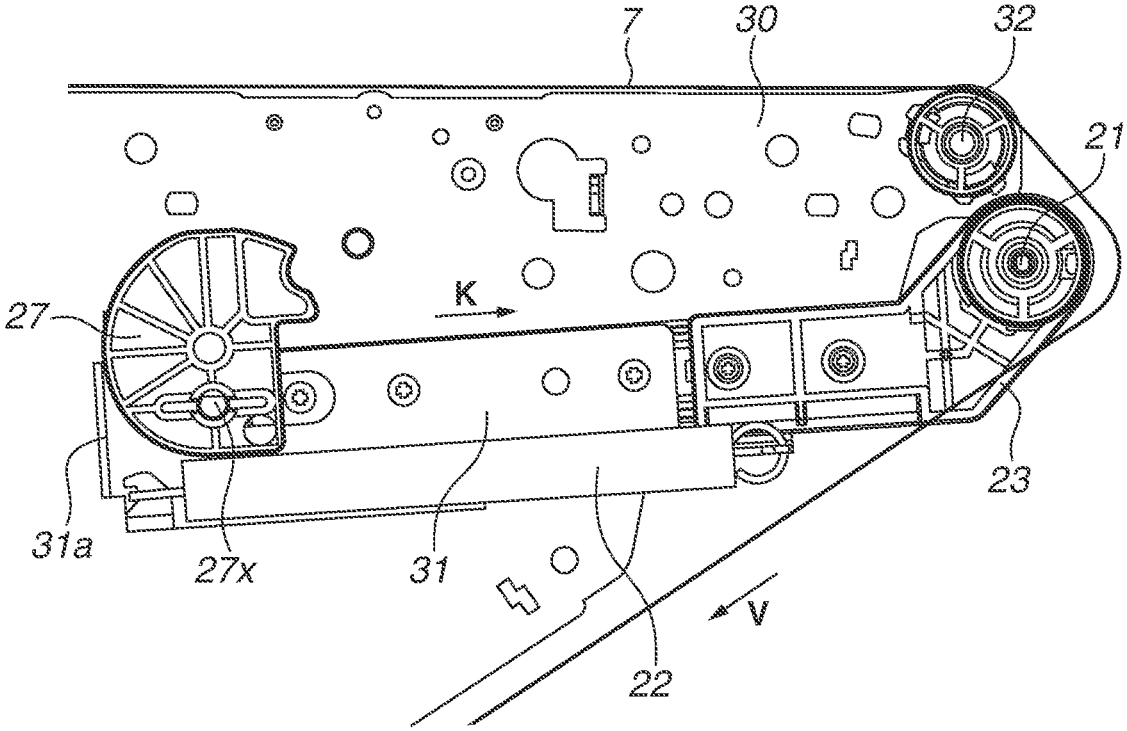

FIGS. 3A and 3B are diagrams of a tension roller mechanism.

As illustrated in FIG. 3A, the tension roller 21 presses the transfer belt 7 toward the outside to apply a tensile force to the transfer belt 7. The tension roller 21 is rotatably supported via the tension roller bearing 23. The tension roller spring 22 presses a slide guide 31 in a pressing direction K.

The slide guide 31 is connected to the tension roller bearing 23 and integrally moves with the tension roller bearing 23. The slide guide 31 includes a guide portion that guides the slide guide 31 to move along the pressing direction K of the tension roller spring 22.

Such configurations enable urging forces of the tension roller springs 22 of both end portions to be effectively transmitted to the respective tension roller bearings 23. In a state in which the transfer belt 7 is stretched by the tension roller 21 and other tension rollers (8, 32, and Ri), the tension roller bearing 23 moves in a direction where the tension roller bearing 23 is pulled by the tension roller spring 22. Accordingly, in such a state, the tension roller 21 is pressed against an inner circumferential surface of the transfer belt 7 by an elastic force of the tension roller spring 22, and a tensile force is generated in the transfer belt 7. That is, the tension roller 21 according to the present exemplary embodiment applies an appropriate tensile force to the transfer belt 7 using an urging force from the tension roller spring 22 as an urging member. At this time, even if the transfer belt 7 is intended to be moved in a front direction, the transfer belt 7 cannot be removed due to a large friction force generated between the transfer belt 7 and the tension roller 21.

Accordingly, a movement mechanism capable of moving the tension roller 21 is disposed. The movement mechanism can move the tension roller 21 to a position in which a tensile force is applied to the transfer belt 7 and to a position in which the tensile force to the transfer belt 7 is released. As illustrated in FIG. 3B, a tension roller separation member 27 as the movement mechanism is moved at the time of belt replacement to separate the tension roller 21 from an inner circumferential surface of the transfer belt 7. In addition, the movement mechanism includes a positioning mechanism that sets the tension roller 21 in a pressure release position. In the width direction of the transfer belt 7, the tension roller separation member 27 is disposed on a side opposite the drive unit 25.

The tension roller separation member 27 is rotated counterclockwise by 90 degrees about a rotation shaft 27*x* of the tension roller separation member 27, so that the tension roller separation member 27 contacts a contact surface 31*a* of the slide guide 31 connected to the tension roller bearing 23. Then, the slide guide 31 is moved in a direction opposite the pressing direction K. With such an operation, the tension roller 21 is positioned inward from a projection surface stretched by the transfer belt 7. Thus, in a case where the transfer belt 7 is moved in a front direction, the transfer belt 7 can be removed since a friction force is not generated between the transfer belt 7 and the tension roller 21.

<Transfer Cleaning Device>

Figure 4:
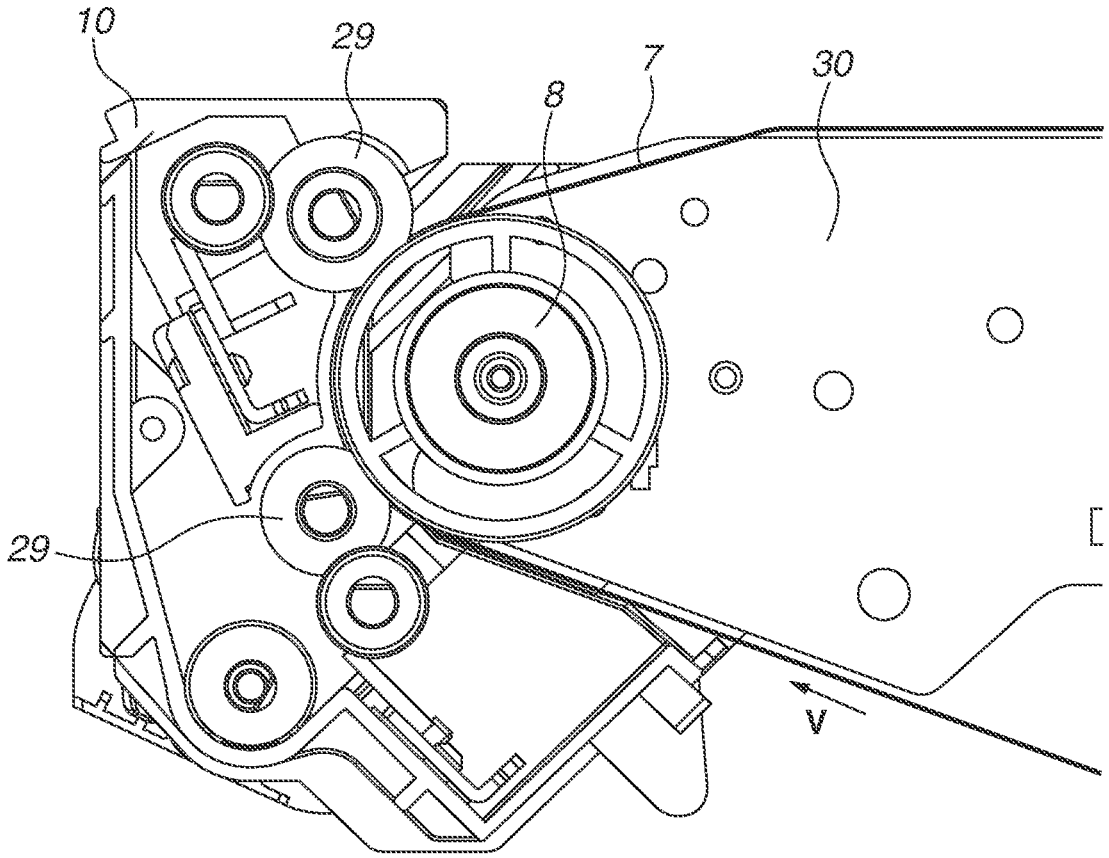
FIG. 4 is a schematic sectional view illustrating a transfer clearing device according to the present exemplary embodiment.

FIG. 4 is a diagram illustrating a configuration of the transfer clearing device 10.

As illustrated in FIG. 4, the transfer clearing device 10 includes a cleaning roller 29 that rubs an outer circumferential surface of the transfer belt 7 to collect transfer residual toner. The cleaning roller 29 is disposed opposite the drive roller 8 via the transfer belt 7. The cleaning roller 29 rotates in a counter direction with respect to a conveyance direction of the transfer belt 7. The conveyance direction of the transfer belt 7 is indicated by an arrow V. The transfer clearing device 10 collects, for example, transfer residual toner remaining on the transfer belt 7 without being transferred to the recording paper P. A configuration in which a cleaning blade made of urethane rubber contacts an outer circumferential surface of the transfer belt 7 can be employed, instead of the cleaning roller 29.

<Secondary Transfer Guide Configuration>

A secondary transfer guide configuration included in the secondary transfer unit 9 according to the present exemplary embodiment is described in detail.

Figure 5:
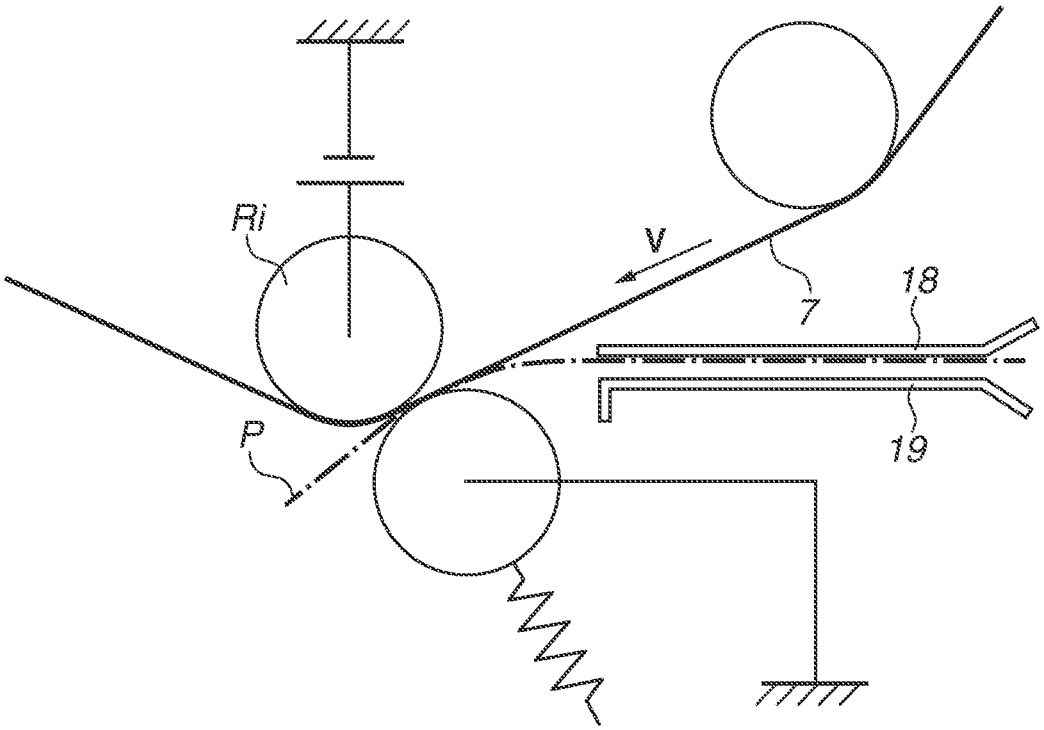
FIG. 5 is a schematic sectional view illustrating a secondary transfer unit according to the present exemplary embodiment.

FIG. 5 is a schematic sectional view of the secondary transfer unit 9. The secondary transfer unit 9 includes a secondary transfer upstream guide including two conveyance guides 18 and 19 (a pre-secondary-transfer upper guide 18 and a pre-secondary-transfer lower guide 19) that are positioned upstream of the secondary transfer nip N in a conveyance direction of the recording paper P. The secondary transfer upstream guide includes the pre-secondary-transfer upper guide 18 disposed on a side of the transfer belt 7. The secondary transfer upstream guide includes the pre-secondary-transfer lower guide 19 disposed on a side opposite the transfer belt 7 relative to the pre-secondary-transfer upper guide 18. A position of the pre-secondary-transfer upper guide 18 is fixed with respect to the belt conveyance apparatus 200, and the pre-secondary-transfer upper guide 18 has a function of regulating excess contact of the recording paper P passing through the secondary transfer unit 9 with the transfer belt 7 in an upstream of the secondary transfer nip N.

<Belt Replacement Procedure according to Conventional Technique>

A belt replacement procedure according to a conventional technique is described with reference to FIGS. 6A through 6D. FIGS. 6A through 6D illustrate the belt conveyance apparatus 200 in a case where a conventional technique is applied.

Figure 6A:
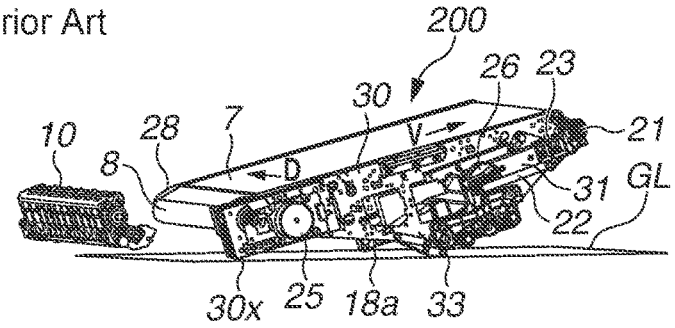
Prior Art FIG.6A
FIGS. 6A, 6B, 6C, and 6D are diagrams illustrating a conventional belt replacement procedure.
Figure 6B:
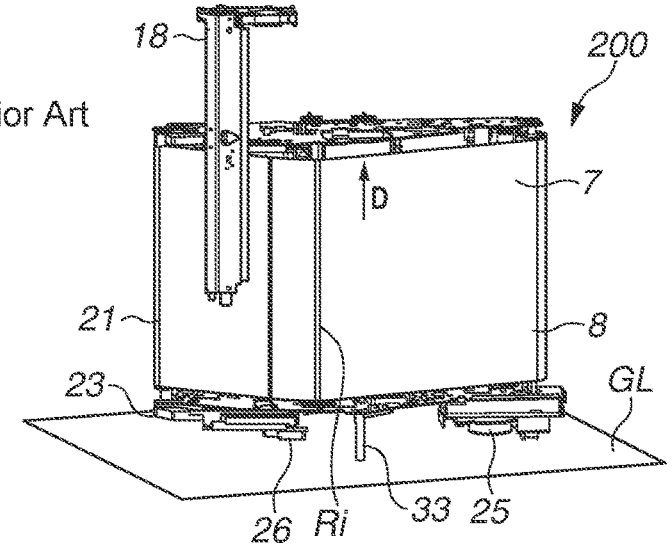
Prior Art FIG.6B

First, the transfer clearing device 10 needs to be removed from the belt conveyance apparatus 200 after the belt conveyance apparatus 200 has been removed from the image forming apparatus body. As illustrated in FIG. 6A, the belt conveyance apparatus 200 is horizontally placed on a bench such as a workbench GL after the belt conveyance apparatus 200 has been removed from the image forming apparatus body, and the transfer clearing device 10 is removed. At this time, the belt conveyance apparatus 200 is supported at three locations by a leg portion 30*x* of the frame 30, a leg member 33, and a leg portion 18*a* of the pre-secondary-transfer upper guide 18. As for the removal of the transfer clearing device 10, the belt conveyance apparatus 200 is horizontally placed as illustrated in FIG. 6A since vertical placement of the belt conveyance apparatus 200 on a bench such as the work bench GL as illustrated in FIG. 6B causes collected toner inside the transfer clearing device 10 to be scattered.

Next, the pre-secondary-transfer upper guide 18 needs to be removed from the belt conveyance apparatus 200. The belt conveyance apparatus 200 is vertically placed on a bench such as the workbench GL as illustrated in FIG. 6B, and the pre-secondary-transfer upper guide 18 is removed. At this time, the belt conveyance apparatus 200 is supported at two locations by the leg member 33 of the belt conveyance apparatus 200 and the drive unit 25 having a heavy weight. In a case where the belt conveyance apparatus 200 is horizontally placed on the workbench GL as illustrated in FIG. 6A, it is difficult to see the pre-secondary-transfer upper guide 18. Consequently, the transfer belt 7 may be damaged at the time of removal of such a pre-secondary-transfer upper guide 18. Thus, an orientation of the belt conveyance apparatus 200 is set as illustrated in FIG. 6B, and the pre-secondary-transfer upper guide 18 is removed.

Figure 6C:
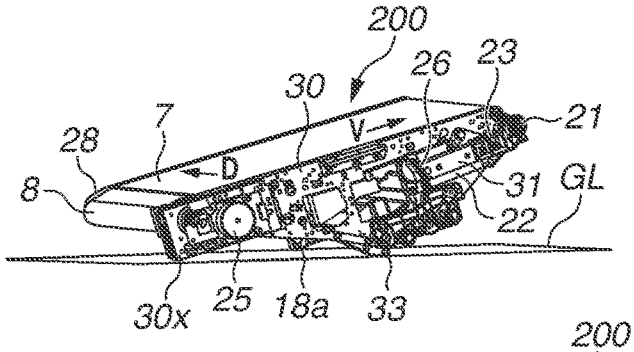
FIG.6C Prior Art

Subsequently, a pressure on the transfer belt 7 needs to be released. The pressure on the transfer belt 7 is released by moving a tension roller separation handle member 26. At this time, as illustrated in FIG. 6C, the belt conveyance apparatus 200 is horizontally placed on a bench such as the workbench GL. In a case where the belt conveyance apparatus 200 is vertically placed on the workbench GL as illustrated in FIG. 6B, access to the tension roller separation handle member 26 is hindered, and the transfer belt 7 may be damaged.

Figure 6D:
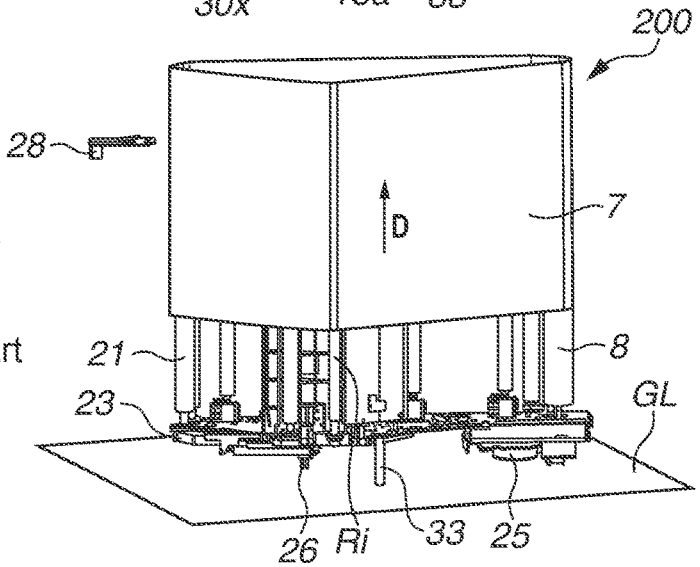
FIG.6D Prior Art

In addition, the insertion-removal guide member 28 is removed for insertion and/or removal of the transfer belt 7. After the insertion-removal guide member 28 is removed, lastly, the transfer belt 7 is inserted and/or removed. In a case where the transfer belt 7 is inserted and/or removed, the belt conveyance apparatus 200 is vertically placed on a bench such as the workbench GL as illustrated in FIG. 6D.

Thus, in the belt replacement procedure according to the conventional technique, since the belt conveyance apparatus 200 needs to be horizontally and vertically placed in a repeated manner, an orientation of the belt conveyance apparatus 200 is changed for a plurality of times. Therefore, the belt replacement work is difficult.

<Belt Replacement Procedure according to Present Exemplary Embodiment>

A belt replacement procedure according to the present exemplary embodiment is described with reference to FIGS. 7A through 7D that illustrate the belt conveyance apparatus 200 according to the present exemplary embodiment.

Figure 7A:
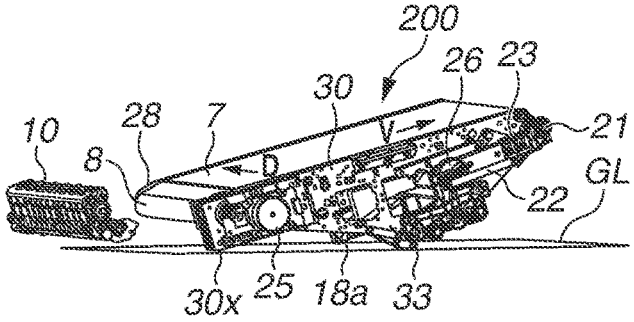
FIGS. 7A, 7B, 7C, and 7D are diagrams illustrating a belt replacement procedure according to the present exemplary embodiment.
Figure 7B:
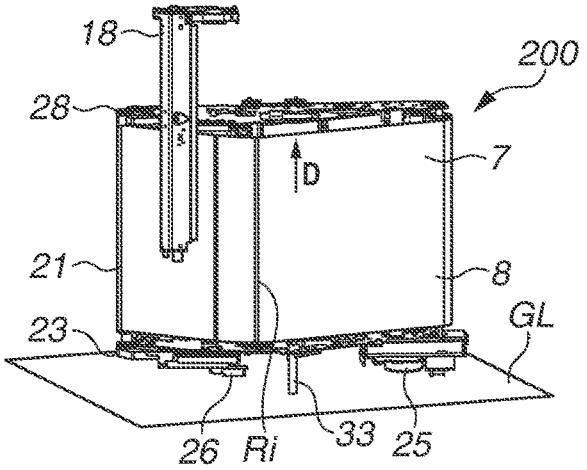

First, the transfer clearing device 10 needs to be removed from the belt conveyance apparatus 200 after the belt conveyance apparatus 200 has been removed from the image forming apparatus body. As illustrated in FIG. 7A, the belt conveyance apparatus 200 is horizontally placed on a bench such as the workbench GL after the belt conveyance apparatus 200 has been removed from the image forming apparatus body, and the transfer clearing device 10 is removed. At this time, the belt conveyance apparatus 200 is supported at three locations by the leg portion 30*x* of the frame 30, the leg member 33, and the leg portion 18*a* of the pre-secondary-transfer upper guide 18. As for the removal of the transfer clearing device 10, the transfer clearing device 10 is removed as illustrated in FIG. 7A since vertical placement of the belt conveyance apparatus 200 on the work bench GL as illustrated in FIG. 7B causes collected toner inside the transfer clearing device 10 to be scattered.

Next, the pre-secondary-transfer upper guide 18 needs to be removed from the belt conveyance apparatus 200. The belt conveyance apparatus 200 is vertically placed on a bench such as the workbench GL as illustrated in FIG. 7B, and the pre-secondary-transfer upper guide 18 is removed. At this time, the belt conveyance apparatus 200 is supported at two locations by the leg member 33 and the drive unit 25.

The drive unit 25 has a heavy weight and is placed near a barycenter position of the belt conveyance apparatus 200. As placement of the belt conveyance apparatus 200 with a barycenter position of the belt conveyance apparatus 200 lowered stabilizes the belt conveyance apparatus 200, the drive unit 25 is placed on a lower side and the pre-secondary-transfer upper guide 18 is removed. In a case where the belt conveyance apparatus 200 is horizontally placed on the workbench GL as illustrated in FIG. 7A, it is difficult to see the pre-secondary-transfer upper guide 18. Consequently, the transfer belt 7 may be damaged at the time of removal of the pre-secondary-transfer upper guide 18. Thus, the belt conveyance apparatus 200 is vertically placed on the workbench GL as illustrated in FIG. 7B, and the pre-secondary-transfer upper guide 18 is removed. In addition, the insertion-removal guide member 28 is removed for insertion and/or removal of the transfer belt 7. Lastly, the transfer belt 7 is inserted and/or removed after the insertion-removal guide member 28 is removed.

Figure 7C:
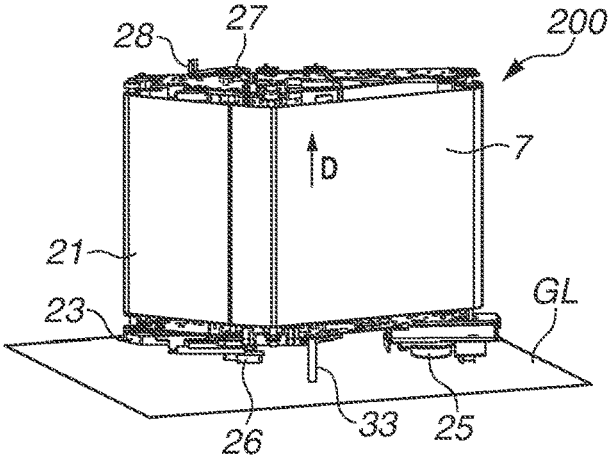
Figure 7D:
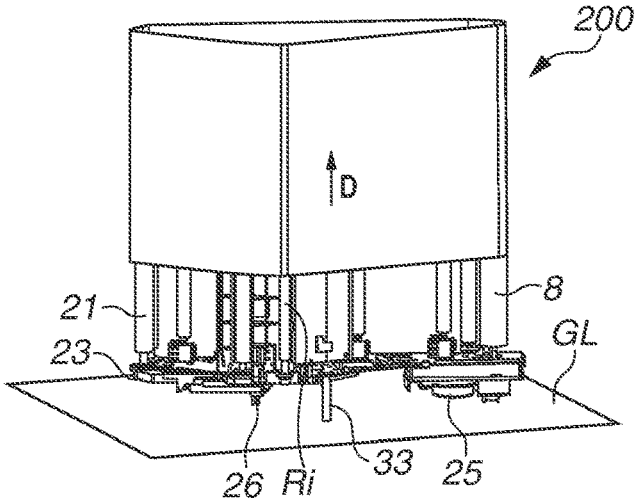

Subsequently, as illustrated in FIG. 7C, the insertion-removal guide member 28 is connected to the tension roller separation member 27. Such connection enables an operator to manually move the tension roller separation member 27 via the insertion-removal guide member 28, and a pressure of the tension roller 21 can be released. Lastly, as illustrated in FIG. 7D, the transfer belt 7 is inserted and/or removed.

According to the present exemplary embodiment, the tension roller separation member 27 includes a pair of rib portions 27*a* as attachment portions to which the insertion-removal guide member 28 can be detachably attached. Accordingly, the operator can manually move the tension roller separation member 27 via the insertion-removal guide member 28, and a pressure of the tension roller 21 can be released. That is, the insertion-removal guide member 28 can also be used as a lever member to operate the tension roller separation member 27.

Moreover, the insertion-removal guide member 28 according to the present exemplary embodiment includes a plate portion 28*a* that is attached to the frame 30 of the belt conveyance apparatus 200. In addition, the insertion-removal guide member 28 includes a guided portion 28*c*, which is protruded from the plate portion 28*a*, as a protrusion portion that is guided by a guide rail by contacting the guide rail. In a case where the insertion-removal guide member 28 functions as the lever member for the tension roller separation member 27, a slit 28*b* included in the insertion-removal guide member 28 is used. The slit 28*b* serves as an engagement portion that is to be engaged with the pair of rib portions 27*a* of the tension roller separation member 27.

In the belt replacement procedure according to the present exemplary embodiment, as described above, the number of times in which an orientation of the belt conveyance apparatus 200 is changed by horizontally and vertically placing the belt conveyance apparatus 200 can be one, so that the belt replacement work can be easily performed.

The present exemplary embodiment has been described using an example in which the insertion-removal guide member 28 serves also as a handle member (a lever member) that operates the tension roller separation member 27. However, the present exemplary embodiment is not limited thereto. For example, a handle member can be detachably attached to a drive unit side of a movement mechanism. In such a case, when a belt is replaced, the lever member can be removed from the drive unit side, and the removed lever member can be connected to a tension roller separation member 27 on a belt insertion/removal side. Alternatively, the tension roller separation handle member 26 for operating the tension roller separation member 27 can be disposed in an undetachable manner on a side of the drive unit 25 of the belt conveyance apparatus 200, as similar to the conventional manner. In such a case, a detachable lever member can be disposed on a side opposite the drive unit 25 of the belt conveyance apparatus 200.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-188976, filed Nov. 12, 2020, which is hereby incorporated by reference herein in its entirety.

What is claimed is:

1. An image forming apparatus comprising:

an image forming unit configured to form a toner image on an image bearing member; and a belt conveyance apparatus detachably disposed, wherein the belt conveyance apparatus includes a transfer belt, a tension roller, a movement mechanism, and a drive unit, wherein the toner image formed on the image bearing member is to be transferred to the transfer belt, and the tension roller is configured to apply tension to the transfer belt, wherein the movement mechanism is configured to move the tension roller to a position in which the tension is applied to the transfer belt and a position in which the tension to the transfer belt is released, and the drive unit is disposed on one end side of the transfer belt in a width direction and configured to drive the transfer belt, and wherein the movement mechanism includes an attachment portion that is disposed on a side opposite the drive unit in the width direction and to which a handle member configured to operate the movement mechanism is detachably attached, and the movement mechanism is configured such that the belt conveyance apparatus is attached to a body of the image forming apparatus in a state in which the handle member is detached from the attachment portion.

2. The image forming apparatus according to claim 1, wherein the drive unit has one portion that is disposed in a position protruding outward relative to an outer circumferential surface of the transfer belt as viewed from the width direction of the transfer belt.

3. The image forming apparatus according to claim 1, further comprising a guide member detachably attached to the belt conveyance apparatus and configured to be guided, wherein the guide member is attachable to the attachment portion of the movement mechanism in a case where the guide member is removed from the belt conveyance apparatus, and serves also as the handle member.

4. The image forming apparatus according to claim 3, wherein the guide member is disposed on the side opposite the drive unit in the width direction, and removal of the guide member enables the transfer belt to be inserted into and/or removed from the belt conveyance apparatus.

5. The image forming apparatus according to claim 3, wherein the guide member includes:

a plate portion that is attached to a frame of the belt conveyance apparatus, a protrusion portion that protrudes from the plate portion and is configured to be guided, and an engagement portion configured to be engaged with the attachment portion of the movement mechanism in the case where the guide member is removed from the belt conveyance apparatus.

* * * * *